United States Patent [19]

Spatafora et al.

[11] Patent Number: 4,995,223

[45] Date of Patent: Feb. 26, 1991

[54] CONTINUOUS WRAPPING MACHINE

[75] Inventors: Mario Spatafora; Antonio Gamberini, both of Bologna, Italy

[73] Assignee: G.D. Societa' per Azioni, Bologna, Italy

[21] Appl. No.: 494,133

[22] Filed: Mar. 14, 1990

[30] Foreign Application Priority Data

Mar. 14, 1989 [IT] Italy ..... 3376 A/89

[51] Int. Cl.[5] ..... B65B 11/04

[52] U.S. Cl. ..... 53/176; 53/216; 53/234; 53/380

[58] Field of Search ..... 53/465, 466, 211, 212, 53/216, 234, 225, 380, 176; 198/343.2, 459, 474.1

[56] References Cited

U.S. PATENT DOCUMENTS

| | | | |
|---|---|---|---|
| 1,116,560 | 11/1914 | Buhse | 53/211 |
| 1,875,567 | 9/1932 | Daniels | 53/212 |
| 2,626,702 | 1/1953 | Basus | 198/343.2 |
| 2,938,319 | 5/1960 | Nystrand | 53/380 X |
| 3,659,394 | 5/1972 | Hartleib | 53/216 X |
| 3,899,865 | 8/1975 | Revaz | 53/225 X |
| 4,408,435 | 10/1983 | Sutton | 53/225 |
| 4,506,779 | 3/1985 | Seraenoli | 198/474.1 |
| 4,822,536 | 4/1989 | Manservigi | 53/234 X |

*Primary Examiner*—John Sipos

*Attorney, Agent, or Firm*—Marshall, O'Toole, Gerstein, Murray & Bicknell

[57] ABSTRACT

A machine for wrapping products, wherein a first conveying means presents a number of seats for successively feeding the products at constant speed and along a predetermined route through a number of fixed work stations for forming about each product at least one tubular wrapping having two opposite end portions projecting from the respective ends of the product, and for closing the end portions of each tubular wrapping about the respective ends of the product; closure of the end portions being performed in a fixed closing station wherein second conveying means reverse each seat in such a manner as to arrest the same for a given length of time.

8 Claims, 2 Drawing Sheets

FIG. 2
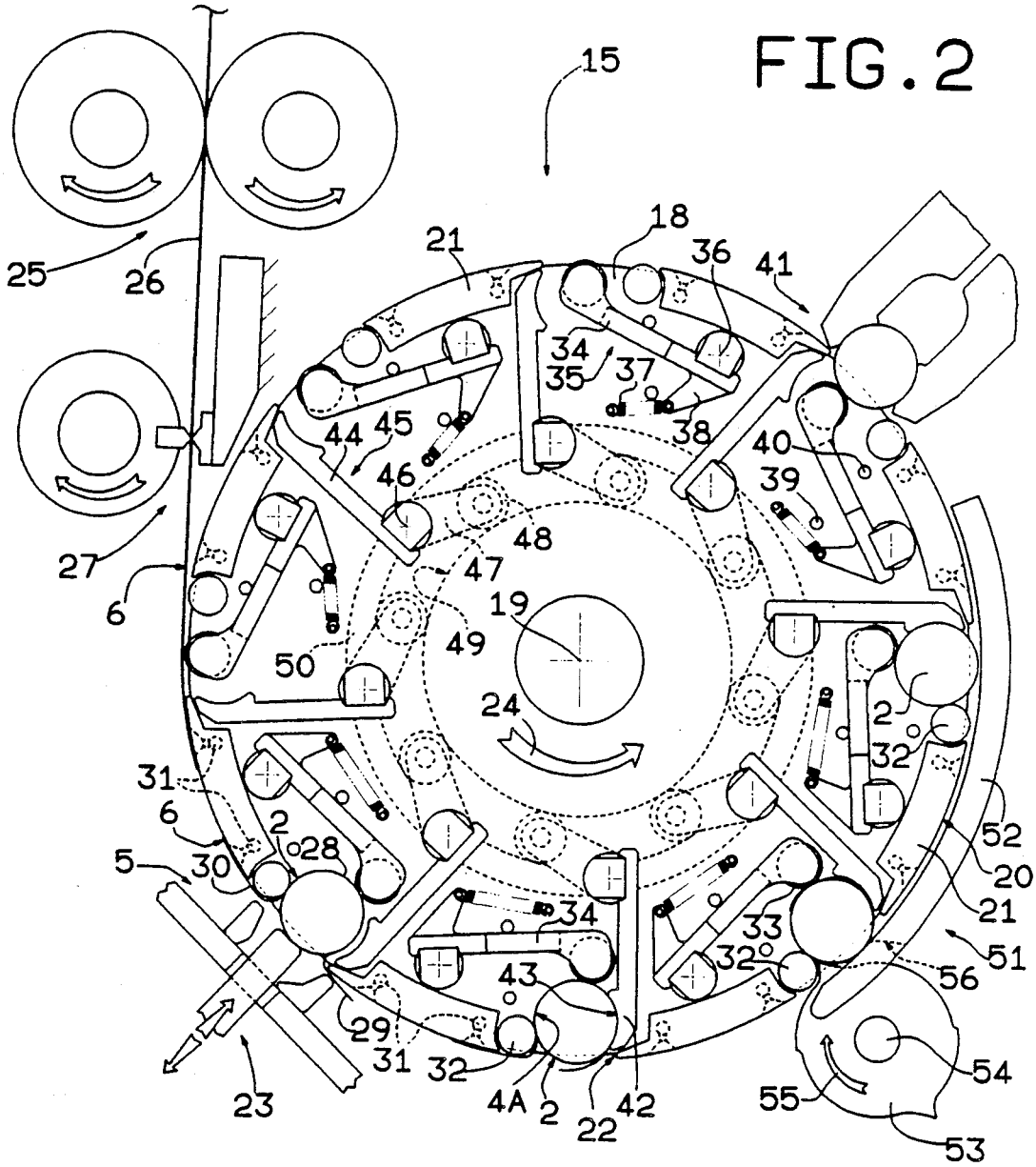
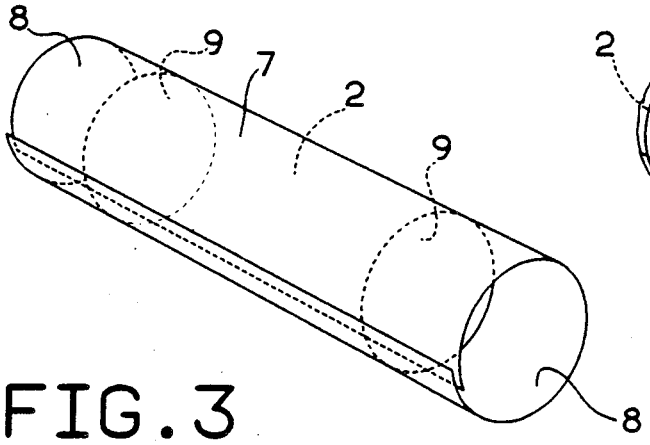
FIG. 3
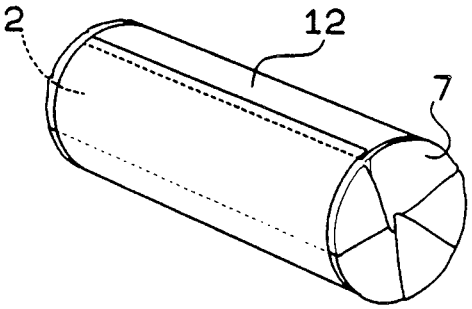
FIG. 4

CONTINUOUS WRAPPING MACHINE

BACKGROUND OF THE INVENTION

The present invention relates to a continuous wrapping machine.

In particular, the present invention relates to a continuous machine which may be used to advantage in the food industry for wrapping preferably cylindrical-shaped products, such as biscuits or sweets or groups of the same arranged side by side.

Products of the aforementioned type are known to be wrapped on continuous machines usually comprising a number of tangent conveyor rollers for continuously and successively feeding the unwrapped products along a substantially sinusoidal route, along which the products are subjected to a number of wrapping operations. Said wrapping operations usually comprise the formation, about each product, of a tubular wrapping, usually longer than the product, the opposite ends of which project beyond the ends of the product, and are folded or otherwise closed over the same to form a closed wrapping.

One of the major drawbacks of known continuous machines of the aforementioned type is that, by virtue of having to be performed as the products are fed continuously along said route, substantially all the above wrapping operations require a number of devices designed to travel with the products and at least equal in number to the number of products subjected simultaneously to a given operation. If, for example, the unwrapped products are fed successively by a roller for closing the ends of the tubular wrapping, and are housed inside respective seats on the same, each seat usually presents a number of folding elements for engaging the ends of the tubular wrapping.

Known wrapping machines of the aforementioned type are therefore invariably complex in design, relatively high cost and relatively poor reliability.

SUMMARY OF THE INVENTION

The aim of the present invention is to provide a continuous machine for wrapping cylindrical products, designed to overcome the above drawbacks. With this aim in view, according to the present invention, there is provided a continuous wrapping machine comprising a number of seats, each designed to receive a respective unwrapped product; first conveying means for successively feeding said seats at constant speed along a predetermined route; and a number of work stations located along said route; a first of said stations being designed to feed a said product inside each said seat, together with a respective portion of wrapping material, for forming, about said product, at least a first tubular wrapping comprising two opposite end portions projecting from the respective ends of said product; and a second of said stations being designed to close said end portions of each said tubular wrapping about the respective ends of said product; characterised by the fact that said second work station is located in a fixed position along said route, and that second conveying means are provided, at least along a portion of said route extending through said second station, for reversing each said seat, in said second station, in relation to said first conveying means and at said travelling speed.

BRIEF DESCRIPTION OF THE DRAWINGS

A non-limiting embodiment of the invention will be described by way of example with reference to the accompanying drawings, in which:

FIG. 2 shows a larger-scale view of a detail in FIG. 1;

FIG. 3 shows a larger-scale view in perspective of a partially wrapped product;

FIG. 4 shows a larger-scale view in perspective of a wrapped product.

DETAILED DESCRIPTION OF THE INVENTION

Figure 1:
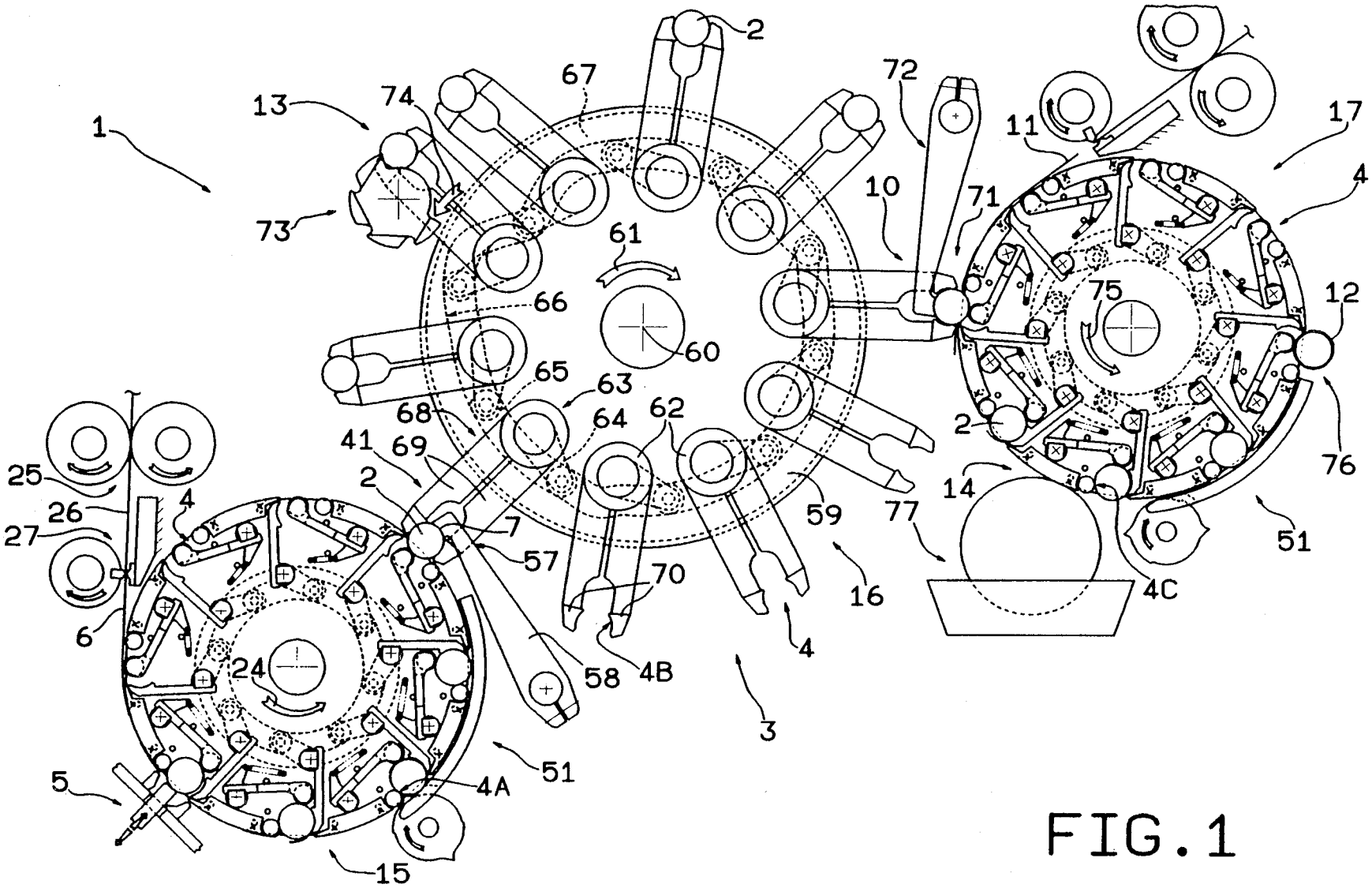
FIG. 1 shows a schematic view of a preferred embodiment of the wrapping machine according to the present invention.

Number 1 in FIG. 1 indicates a machine for wrapping products 2 consisting, in the example shown, of cylindrical products consisting of groups of cylindrical sweets arranged side by side.

Machine 1 comprises a first conveying means or unit 3 having a number of seats 4, each designed to receive a respective product 2, and fed successively by unit 3 at substantially constant speed along a predetermined route through a number of work stations.

Said work stations comprise a station 5 for feeding a product 2 inside each seat 4, together with a respective portion 6 of wrapping material, for forming, about product 2, a first tubular wrapping 7 (FIG. 3) comprising two opposite end portions 8 projecting from respective ends 9 of product 2; and a further station 10 for feeding inside each seat 4 a respective further portion 11 of wrapping material, for forming, about said wrapping 7, a second tubular wrapping 12 (FIG. 4) substantially of the same length as product 2.

Said stations also comprise a station 13 for closing end portions 8 of each tubular wrapping 7 about the respective ends 9 of said product 2; and a station 14 for gumming one end of each portion 11. Unit 3 comprises three conveying devices or rollers 15, 16 and 17, of which roller 15 provides for forming said first wrapping 7; roller 16 for closing portions 8 about ends 9 of product 2; and roller 17 for forming said second tubular wrapping 12.

As shown in FIG. 2, roller 15 consists of a disc 18 jogged about a central shaft 19 by a drive unit (not shown) and having, about its outer periphery, a cylindrical jacket 20 projecting from a surface of disc 18. Said jacket 20 is divided into a number of identical, equally-spaced segments 21 by slots defining the inlets 22 of respective seats 4 which, in the case of roller 15, are numbered 4A. Said seats 4A are carried on roller 15 and designed to receive respective products 2 fed successively on to roller 15 by a feeder 23 in station 5.

Upstream from feeder 23 in relation to the travelling direction of roller 15 indicated by arrow 24, there is provided a further device 25 for feeding a strip 26 of wrapping material, which is cut by a cutting unit 27 into portions 6, which are fed successively into contact with the outer surface of jacket 20 so that each substantially closes the inlet 22 of a respective seat 4A. As shown in FIG. 2, each portion 6 is arranged with an intermediate portion 28 over respective inlet 22, and a front and rear portion 29 and 30 contacting the outer surface of jacket 20. Said portions 29 and 30 are held contacting jacket 20 by respective known suction devices 31 connected to a suction pump (not shown).

Each seat 4 is defined by a first roller 32 located at the rear end of respective inlet 22 and mounted in idle manner on disc 18 so as to turn about its axis perpendicular to arrow 24 and parallel to shaft 19. Each seat 4 is also defined by a second roller 33 mounted for rotation about an axis parallel to shaft 19 and on the end of a first arm 34 of a rocker arm 35. This pivots at point 36 on disc 18 so as to rotate in relation to the same about an axis parallel to shaft 19 and against the thrust exerted by a spring 37 located between disc 18 and one end of a second arm 38 of rocker arm 35. By virtue of spring 37, each roller 33 moves from a withdrawn position, wherein arm 34 contacts a first stop element 39 on disc 18, and an extracted position wherein arm 34 contacts a second stop element 40 on disc 18. Between said withdrawn and extracted positions, roller 33 is also designed to assume two intermediate positions, one close to said withdrawn position and the other to said extracted position.

As shown in FIG. 2, roller 33 is moved elastically from said extracted to said withdrawn position by the insertion of respective product 2 inside seat 4A at station 5, and moves into the extracted position for unloading product 2 from seat 4A at a transfer station 41 wherein product 2 is transferred to a seat 4 on roller 16 hereinafter referred to as seat 4B.

Each seat 4A on roller 15 is also defined by a mobile guide and lock pad 42 having a cylindrical concave surface 43 mating with the outer surface of product 2 located inside seat 4A contacting both roller 32 and roller 33 in the withdrawn position. Pad 42 is connected integral with the end of a first arm 44 of a rocker arm 45 pivoting at point 46 on disc 18 so as to turn, in relation to the same, about an axis parallel to shaft 19. Rocker arm 45 comprises a second arm 47, the end of which is connected to a tappet 48 mating with a cam 49 formed on a fixed drum 50 coaxial with disc 18. As roller 15 turns, cam 49 moves pad 42, in relation to disc 18 and in a direction substantially parallel to arrow 24, between a withdrawn release position and a forward lock position. Cam 49 is also designed to arrest pad 42 in an intermediate position close to said forward lock position.

Part of the outer surface of jacket 20 extending at any time between loading and transfer stations 5 and 41 is arranged facing a rolling station 51 comprising a fixed curved plate 52. Upstream from plate 52, there is provided a folding roller element 53 fitted on to a drive shaft 54 parallel to shaft 19, so as to turn in the direction of arrow 55, opposite that of arrow 24, and successively engage and fold back front portions 29 of portions 6 into contact with the outer surface of respective products 2 as these engage plate 52. For this purpose, folding element 53 engages an axial slot 56 formed along the initial portion of plate 52. In actual use, when a portion 6 of wrapping material is fed on to jacket 20 upstream from loading station 5 and in such a manner as to close inlet 22 of a respective seat 4A, rocker arm 35 of said seat 4A is positioned by spring 37 in the extracted position contacting stop element 40, and respective pad 42 is secured in the withdrawn release position.

As already stated, upon insertion of product 2 inside seat 4A at loading station 5, intermediate portion 28 of portion 6 is inserted inside seat 4A and, at the same time, rocker arm 35 is moved by product 2 into the withdrawn position contacting stop element 38 and against the thrust exerted by spring 37 As soon as product 2 is inserted inside seat 4A, pad 42 moves into the forward lock position to prevent product 2 from being expelled from seat 4A by spring 37 upon leaving loading station 5.

As shown in FIGS. 1 and 2, upon insertion of product 2 inside seat 4A, rear portion 30 of portion 6, which is held on to jacket 20 by respective suction device 31, slides forward in the direction of arrow 24, whereas front portion 29, which is released from respective suction device 31, slides and is folded backwards (FIG. 2) substantially into contact with the outer surface of product 2.

As product 2 is fed continuosuly beneath the initial portion of plate 52, front portion 29 is engaged by the outer periphery of folding element 53 by which it is pressed firmly backwards on to the outer surface of product 2. At the same time, cam 49 moves pad 42 from the forward lock position into an intermediate position extremely close to the forward lock position but sufficient to partially release prouct 2 and enable roller 33 to move, by virtue of spring 37, into its first intermediate position, wherein product 2 is positioned contacting plate 52 Subsequent to such contact, product 2 rolls about its axis in contact with plate 52, idle rollers 32 and 33 and folding element 53, the outer periphery of which is so designed as to guide and insert front portion 29 of portion 6 beneath roller 32.

Once product 2 has been fully rolled, after which portion 6 is arranged fully contacting the outer surface of product 2 with the end of rear portion 30 overlapping the end of front portion 29, cam 49 moves pad 42 back to the forward lock position. As a result, wrapped product 2 is backed up by surface 43 of pad 42 contacting the outer surface of the same, rocker arm 35 moves back to the withdrawn position contacting stop element 39, are product 2 is detached from plate 52, thus arresting the rolling function.

Product 2 is then fed forward by roller 15 to station 41 at which point pad 42 is moved by cam 49 into the withdrawn release position, thus allowing roller 33 to move, by virtue of spring 37, into said second intermediate position wherein partially-wrapped product 2 is partially expelled from seat 4A and transferred into seat 4B on roller 16.

As shown in FIG. 1, transfer station 41 comprises a counter-pusher 57 consisting of a crank mechanism having an output member consisting of a connecting rod 58, the free end of which is designed to engage each product 2 as it it expelled from respective seat 4A by roller 33, and to accompany the same inside respective seat 4B on roller 16.

As shown in FIG. 1, roller 16 comprises a disc 59 mounted on and turned by a drive device (not shown) about a central shaft 60 parallel to axis 19 at substantially constant speed and in the direction of arrow 61 opposite that of arrow 24 Through disc 59, there are fitted a number of rotary through pins 62 equally spaced about a circumference centering about shaft 60 and about each of which pivots a rocker arm 63 comprising a first carrier arm 64 on its free end, and a tappet roller 65 connected to an actuating means consisting of a cam 66 formed on a fixed disc 67 coaxial with disc 59. Each rocker arm 63 also comprises a second arm extending substantially radially outwards from disc 59 and consisting of a known grip or conveying means 68 in turn comprising two lever arms or supporting means 69 designed to move in relation to each other by means of known actuating devices (not shown). The free end of each arm 69 is fitted with a jaw 70 defining, together with the other jaw 70, a respective seat 4B when respective grip 68 is closed.

The length of grips 68 is such that, when they are set to the normal radial position in relation to disc 59, seats 4B turn about shaft 60 at the same speed as seats 4A and along a circular route substantially tangent to that of seats 4A at station 41.

In actual use, each grip 68 travels through station 41 in the radial position in relation to disc 59, so as to feed seat 4B forward at the same speed as respective seat 4A. Moreover, each grip 68 is parted slightly at station 41 so as to enable transfer of product 2 from seat 4A to seat 4B, and is closed upon product 2 engaging seat 4B so as to remove the same from roller 15 and feed it forward together with roller 16.

Each product 2 is fed forward by respective grip 68 on roller 16 between station 41 and a further transfer station 71, wherein each grip 68 opens for transferring product 2 inside a seat 4 on roller 17, hereinafter referred to as seat 4C, by virtue of an external pusher 72 substantially identical to counter-pusher 57.

Between stations 41 and 71, each grip 68 travels through station 13, wherein end portions 8 of wrapping 7 are closed about ends 9 of product 2, which operation may be performed by any known type of closing device. In the example shown, said operation is performed by a device 73 of the type described and illustrated in Italian Patent Application No. 3660A/88, the content of which fully incorporated herein.

Said closing operation is performed with product 2 in a fixed position in relation to station 13, for which purpose, cam 66 is so designed as to turn each grip 68, in station 13, about respective pin 62 in the direction of arrow 74, opposite that of arrow 61, and at such a speed that respective seat 4B is backed up in relation to disc 59 and maintained stationary in relation to station 13 for the length of time required for performing said closing operation.

Subsequently, each seat 4B is accelerated by cam 66 in the direction of arrow 61 until, by the time it reaches station 71, grip 68 is restored to the normal radial position in relation to disc 59.

Once transferred inside seat 4C, which is carried forward by roller 17 in the direction of arrow 75, opposite that of arrow 61, and at the same speed as seats 4B in station 71, partially-wrapped product 2 is fed to an unloading station 76, wherein it is expelled from respective seat 4C.

Being substantially identical to roller 15 in terms of design and operation, no description will be given here of roller 17, the component parts of which will be referred to hereinafter using the same numbering system as for roller 15.

Between stations 71 and 76, said outer tubular wrapping 12 is formed about partially-wrapped product 2 in exactly the same way as tubular wrapping 7, except that, before reaching rolling station 51, each seat 4C on roller 17 travels through grumming station 14 wherein the inner surface (facing outwards) of the rear portion of each portion 11 of wrapping material is coated with gum by a known gumming device 77.

Machine 1 as described above therefore provides for performing all the wrapping operation, not by means of devices on rollers 15, 16 and 17, but as products 2 are fed through work stations located at fixed points along the route travelled by products 2.

To those skilled in the art it will be clear that changes may be made to machine 1 as described and illustrated herein without, however, departing from the scope of the present invention.

For example, according to a variation not shown, the position of rollers 16 and 17 may be altered for successively forming wrappings 7 and 12 prior to closing end portions 8 of wrapping 7.

According to a further variation not shown, roller 17 may be dispensed with and gumming station 77 assigned to roller 15 for dispensing with outer wrapping 12.

We claim:

1. A continuous wrapping machine comprising a number of seats (4), each designed to receive a respective unwrapped product (2); first conveying means (3) for successively feeding said seats (4) at constant speed along a predetermined route; and a number of work stations (5, 13) located along said route; a first (5) of said stations being designed to feed a said product (2) inside each said seat (4), together with a respective portion (6) of wrapping material, for forming, about said product (2), at least a first tubular wrapping (7) comprising two opposite end portions (8) projecting from the respective ends (9) of said product (2); and a second (13) of said stations being designed to close said end portions (8) of each said tubular wrapping (7) about the respective ends (9) of said product (2); characterised by the fact that said second work station (13) is located in a fixed position along said route, and that second conveying means (68) are provided, at least along a portion of said route extending through said second station (13), for reversing each said seat (4), in said second station (13), in relation to said first conveying means (3) and at said travelling speed.

2. A machine as claimed in claim 1, characterised by the fact that said work stations comprise a third rolling station (51) located in a fixed position along said route, for successively rolling said products (2) and said respective portions (6) of wrapping material inside said respective seats (4) and so forming said first tubular wrapping (7).

3. A machine as claimed in claim 1, characterised by the fact that said first conveying means (3) comprise an input conveyor (15) and an intermediate conveyor (16) for successively feeding said products (2) at constant speed along respective portions of said route; said input conveyor (15) being a first wrapping conveyor for forming said tubular wrapping (7) about each said product (2); and said intermediate conveyor (16) being assigned to said closing station (13) for closing said projecting end portions (8) about respective end surfaces (9) of said product (2).

4. A machine as claimed in claim 3, characterised by the fact that said first conveying means (3) also comprise a second wrapping conveyor (17) for forming over said first tubular wrapping (7) an external tubular wrapping (12) of at most the same length as said product (2); a further rolling station (51) being assigned to said second wrapping conveyor (17).

5. A machine as claimed in claim 4, characterised by the fact that said work stations comprise a fixed station (14) for gumming said external tubular wrapping (12) and assigned to said second wrapping conveyor (17).

6. A machine as claimed in claim 1, characterised by the fact that said second conveying means (68) are carried on said intermediate conveyor (16) and comprise, for each said seat (4), lever supporting means (69) pivoting on said intermediate conveyor (16) for moving said seat (4) in a direction parallel to that of said intermediate conveyor (16); actuating means (66) being assigned to each said lever supporting means (69) for reversing said seat (4) at said closing station (13).

7. A machine as claimed in claim 6, characterised by the fact that said lever supporting means (69) comprise, for each said seat (4), a rocker arm (63) pivoting at an intermediate point on said intermediate conveyor (16) so as to turn in relation to the same about an axis arranged crosswise in relation to the travelling direction of said seat (4); said seat (4) being located on a first end of said rocker arm (63), and cam means (66) being connected to a second end (64) of said rocker arm (63) for turning the same about a respective fulcrum (62) in relation to said intermediate conveyor (16).

8. A machine as claimed in claim 1, characterised by the fact that said closing station consists of a station (13) for closing said portions (8) about the respective ends (9) of said product (2).

* * * * *